US008235360B2

(12) United States Patent
Castellote et al.

(10) Patent No.: US 8,235,360 B2
(45) Date of Patent: Aug. 7, 2012

(54) FLUID JET FOR TUBS

(75) Inventors: Miguel A. Castellote, Sainte-Marguerite-de-Dorchester (CA); Dominique Ciechanowski, Sainte-Marguerite-de-Dorchester (CA)

(73) Assignee: C.G. Air Systèmes Inc., Sainte-Marguerite-de-Dorchester (CA)

( * ) Notice: Subject to any disclaimer, the term of this patent is extended or adjusted under 35 U.S.C. 154(b) by 447 days.

(21) Appl. No.: 12/502,621

(22) Filed: Jul. 14, 2009

(65) Prior Publication Data

US 2010/0006158 A1 Jan. 14, 2010

Related U.S. Application Data

(60) Provisional application No. 61/080,359, filed on Jul. 14, 2008, provisional application No. 61/174,603, filed on May 1, 2009.

(51) Int. Cl.
*B01F 3/04* (2006.01)

(52) U.S. Cl. ..... 261/77; 261/78.2; 4/541.5

(58) Field of Classification Search ..... 261/76, 261/77, 78.2; 4/541.5
See application file for complete search history.

(56) References Cited

FOREIGN PATENT DOCUMENTS

JP 200088341 A * 3/2000

* cited by examiner

*Primary Examiner* — Robert A Hopkins
(74) *Attorney, Agent, or Firm* — Norton Rose Canada LLP

(57) ABSTRACT

A fluid jet for injecting fluids in the liquid of a tub through a throughbore in a wall of the tub comprises a gas injector with a hollow body having a gas inlet receiving a gas flow from a pressurized gas source. A gas outlet produces a flux of gas with the gas flow. A liquid injector comprises a hollow body with a liquid inlet connected to a pressurized liquid source to receive a liquid flow therefrom. A liquid outlet produces a flux of liquid with the liquid flow, the gas injector being received in the hollow body of the liquid injector, for the gas outlet and the liquid outlet to form a common jet outlet. The liquid injector is secured to the wall of the tub opposite the throughbore such that fluids exiting the common jet outlet are directed concurrently through the throughbore into the liquid of the tub.

18 Claims, 14 Drawing Sheets

FLUID JET FOR TUBS

CROSS-REFERENCE TO RELATED APPLICATIONS

This patent application claims priority on U.S. Provisional Patent Applications No. 61/080,359, filed on Jul. 14, 2008, and No. 61/174,603, filed on May 1, 2009.

FIELD OF THE APPLICATION

The present application relates to jet massage systems used in tubs, such as bathtubs, hot tubs, whirlpools and similar basins, and more particularly to a jet for the injection of fluids into the liquid of such tubs to procure a massaging effect for the occupant of the tub.

BACKGROUND OF THE ART

Tubs are well known for their primary use, namely a washroom installation in which a user person washes/bathes. Tubs have, however, evolved to add pleasure and comfort to practicality, and are found in many forms, such as bathtubs, spas and whirlpools. For instance, tubs are now provided with air-jet systems and whirlpool systems.

Massage systems of various configurations have been provided to inject fluids, such as air or water, into the liquid of the tub, so as to procure a massaging effect for the occupant of the tub. One known massage system combines the injection of air and water to provide a different sensorial experience to the bather. The known massage system comprises water jets equipped with venturi devices whereby air is sucked by the flow of water directed to the tub. Accordingly, the resulting flow of water in the tub comprises air bubbles, thereby causing a different sensation on the skin of the bather.

In such a massage system, the water jet pressure must be maintained relatively high to induce a suitable sucking effect on the air in the venturi device. Therefore, the presence of air bubbles is limited in the flux of fluid being injected by the jets.

SUMMARY OF THE APPLICATION

It is therefore an aim of the present application to provide a novel fluid massage system and method that addresses issues associated with the prior art.

Therefore, in accordance with the present application, there is provided a method for injecting fluids in the water of a tub, comprising: providing a jet having a gas injector and a liquid injector sharing a common outlet; supplying pressurized gas to the gas injector of the jet; and simultaneously supplying pressurized liquid to the liquid injector of the jet; whereby gas and liquid exit the common nozzle concurrently.

Further in accordance with the present application, there is provided a method for injecting fluids in the water of a tub, comprising: providing a jet having a gas injector and a liquid injector, with the gas injector and the liquid injector being arranged such that gas and liquid flux exiting the injectors converge; supplying pressurized gas to the gas injector of the jet; and simultaneously supplying pressurized liquid to the liquid injector of the jet; whereby gas and liquid exit the jet concurrently.

DESCRIPTION OF THE PREFERRED EMBODIMENTS

Figure 1:
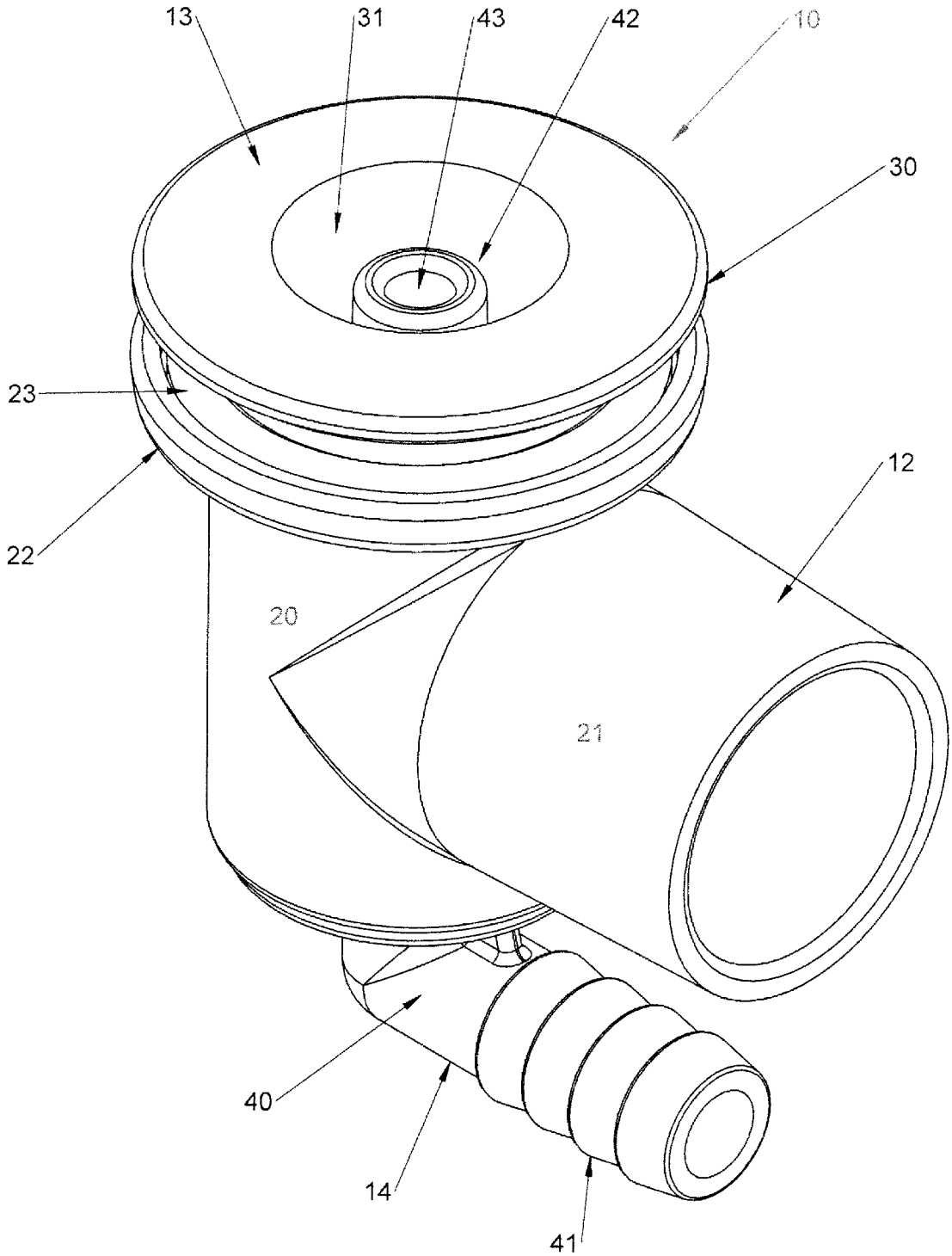
FIG. 1 is a perspective view of a fluid jet in accordance with a first preferred embodiment of the present disclosure.
Figure 2:
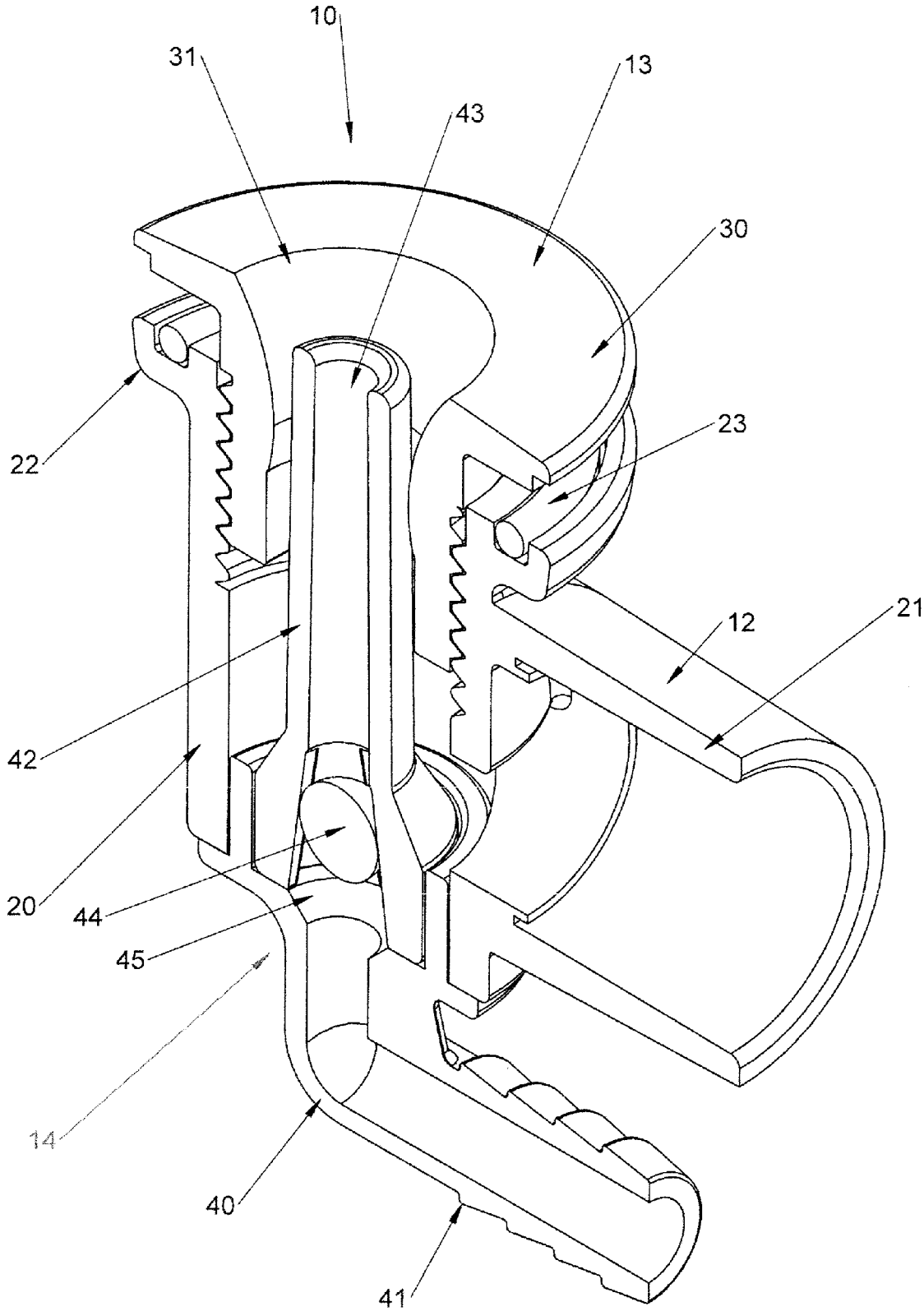
FIG. 2 is a partly sectioned perspective view of the fluid jet of FIG. 1.

Referring to the drawings and more particularly to FIGS. 1 and 2, a fluid jet in accordance with a first preferred embodiment is generally shown at 10. The fluid jet 10 is used to inject both water and air in a tub, as will be described in further detail hereinafter. The injected water and air are referred to as being pressurized. This refers to the fact that they flow through the fluid jets described hereinafter, into the liquid of the tub, with the flow being for instance induced by a pressure source such as a pump, a blower, or any other suitable mechanism or system.

The fluid jet 10 of FIGS. 1 and 2 has a water injector 12, a wall fitting 13 and an air injector 14.

The water injector 12 is the interface between a water piping system and the tub. Therefore, water passes through the water injector 12 to be injected in the tub.

The wall fitting 13 is used to secure the fluid jet 10 to the tub. Water and air exit the fluid jet 10 through the wall fitting 13.

The air injector 14 is the interface between an air pressure system and the tub. Therefore, air passes through the air injector 14 to be injected in the tub.

Referring concurrently to FIGS. 1 and 2, the water injector 12 has a hollow tubular body 20, with a lateral inlet 21 projecting radially from the body 20. The lateral inlet 21 is used for connection with a water pipe and, although not shown, may be provided with tapping, threading or the like for this purpose.

A downstream end of the tubular body 20 supports the air injector 14, whereas a flange 22 is provided at an upstream end of the body 20. The flange 22 is grooved so as to accommodate a seal 23. When the fluid jet 10 is mounted to the tub, the flange 22 is opposite a hidden surface of the wall of the tub, and concentrically aligned with a hole in the wall. Accordingly, the seal 23 is pressed against the hidden surface of the tub to generally prevent leaks between the flange 22 and the hidden surface of the tub. The tubular body 20 is tapped at its upstream end for threading engagement with the wall fitting 13.

The wall fitting 13 has a flange 30. The flange 30 is positioned inside the tub and is therefore visible to a user of the tub. The nozzle 13 has a flared conduit 31 (conduit body) that passes through the hole in the tub and interconnects with the tubular body 20 of the water injector 12, by threading engagement. Therefore, the area of the wall of the tub about the hole is sandwiched between the flanges 22 and 30. By this configuration, the fluid jet 10 is solidly anchored to the wall of the tub, and can withstand the forces associated with the injection of pressurized fluids in the tub.

Although the conduit 31 is flared in FIGS. 1 and 2, other shapes are considered. Moreover, the flange 30 may be provided with additional esthetic features, considering that it will be visible from the tub when the fluid jet 10 is mounted to the wall of the tub.

The air injector 14 has a hollow body, for instance defined by an elbow fitting 40 that is connected to the downstream end of the tubular body 20. The interconnection between the elbow fitting 40 and the tubular body 20 is watertight to prevent leaks, and may result from welding, threading engagement, force-fitting engagement or any other interconnection configuration. The elbow fitting 40 has a hose barb 41 by which the air injector 14 is connected to pressurized air tubing or hose.

A nozzle 42 is connected to the elbow fitting 40 and is concentrically positioned within the tubular body 20. It is observed that the outlet end 43 of the nozzle 42 extends downstream of the lateral inlet 21 of the tubular body 20. Therefore, an annular passage may be defined between the wall fitting 13 and the nozzle 42, and water passes through this annular passage to be injected in the tub. Other passage sections are considered as well.

In order to generally prevent water infiltration in the pressurized air system, a unidirectional flow mechanism, such as a check valve, may be provided with the nozzle 42. In the embodiment of FIGS. 1 and 2, the check valve consists of a sphere 44 and a seat 45. By way of gravity, the sphere 44 is sealingly seated on the seat 45, but is displaceable in response to a predetermined pressure of air in the elbow fitting 40. Other check valves may be used, for instance using biasing members (e.g., springs, flap or flaps), to bias the valve to a normally closed position.

Figure 9:
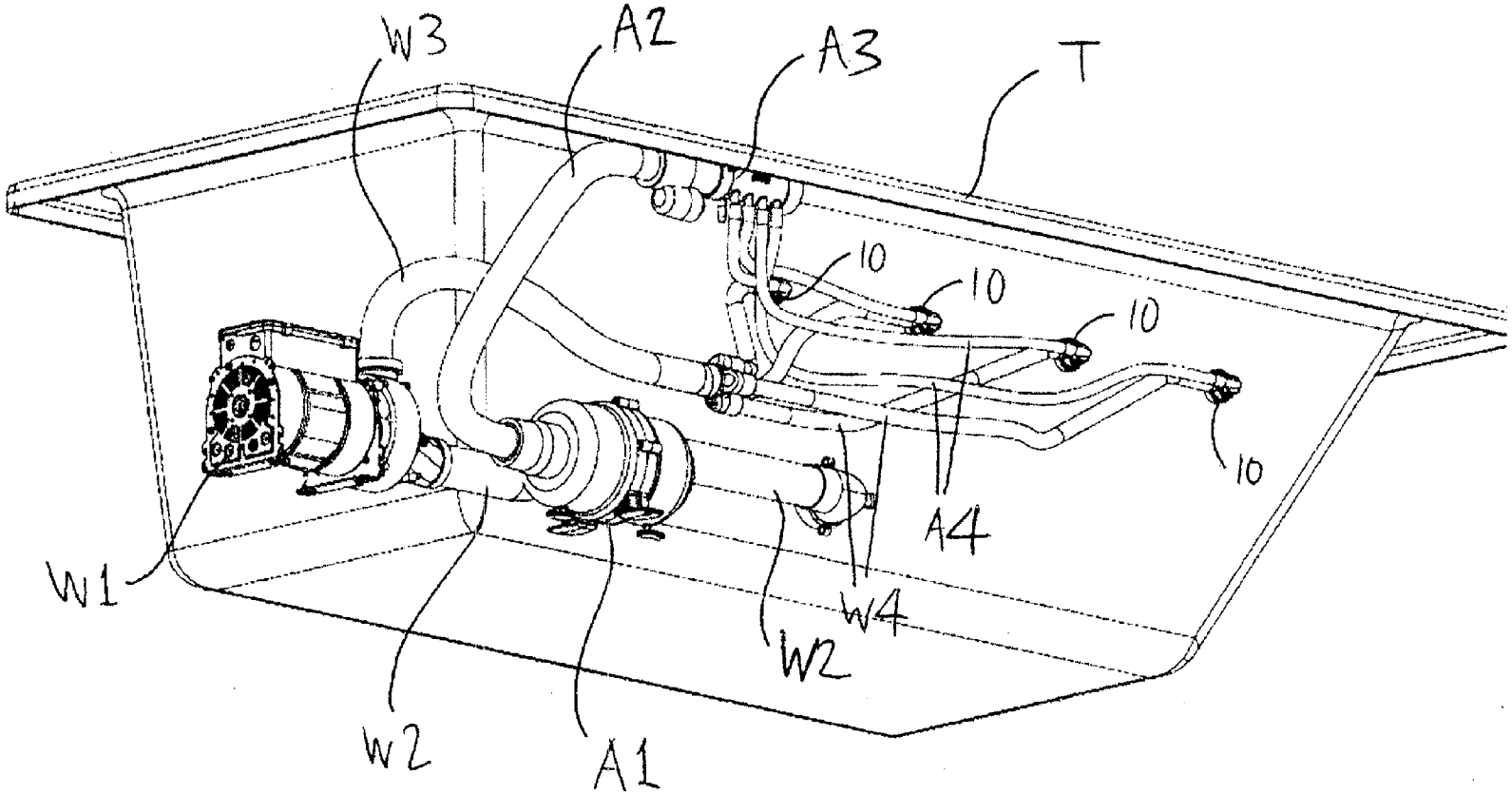
FIG. 9 is a perspective view of a tub equipped with a fluid massage system having fluid jets of the preferred embodiments.

Referring to FIG. 9, a massage system using fluid jets such as the jet 10 is illustrated as mounted to a tub T. The massage system has a blower A1 that has an air intake (not visible in FIG. 9). A main air hose A2 is connected to the outlet of the blower A1, and directs an air flow to a manifold A3. The manifold A3 is provided as a gate between the tub T and the blower A1, to prevent water infiltration in the air hose A2. A plurality of tubings A4 relate the manifold A3 to the fluid jets 10, for injection of air through the fluid jets 10 into the tub T. It is pointed out that the necessary precautions are taken in view of the use of electrical equipment in a tub environment.

The massage system also features a pump W1 having a return pipe W2 connected to the tub T so as to receive water from the tub T. A main water pipe W3 is connected to the outlet of the pump W1, and diverges into a plurality of pipes W4 each connected to one of the fluid jets 10. Therefore, water is injected into the tub T through the fluid jets 10.

Referring to FIGS. 1 and 2, the fluid jet 10 is configured and supplied with pressurized water and air in such a way the flux of water and air from the fluid 10 converge in the fluid of the tub. As both the air and the water are pressured independently from one another, the ratio of air for water is increased. Moreover, the common outlet used by the water injector 12 and the air injector 14 promotes the mixture of the flux and the formation of micro-bubbles. Accordingly, beyond a certain ratio, micro-bubbles of air form in the flux of water. The resulting fine bubbling has a distinct effect on the skin of the bather. Moreover, in some instances, the massaging effect is felt by the bather at an increased distance from the fluid jets 10.

As the venturi effect is not required in the injection of air, the water pump W1 (FIG. 9) may be reduced in power capacity when compared to venturi massage systems.

Numerous configurations are considered for the fluid jet to operate in injecting air and water in the manner described above. Accordingly, like elements will bear like reference numerals in FIGS. 1 to 15.

Figure 3:
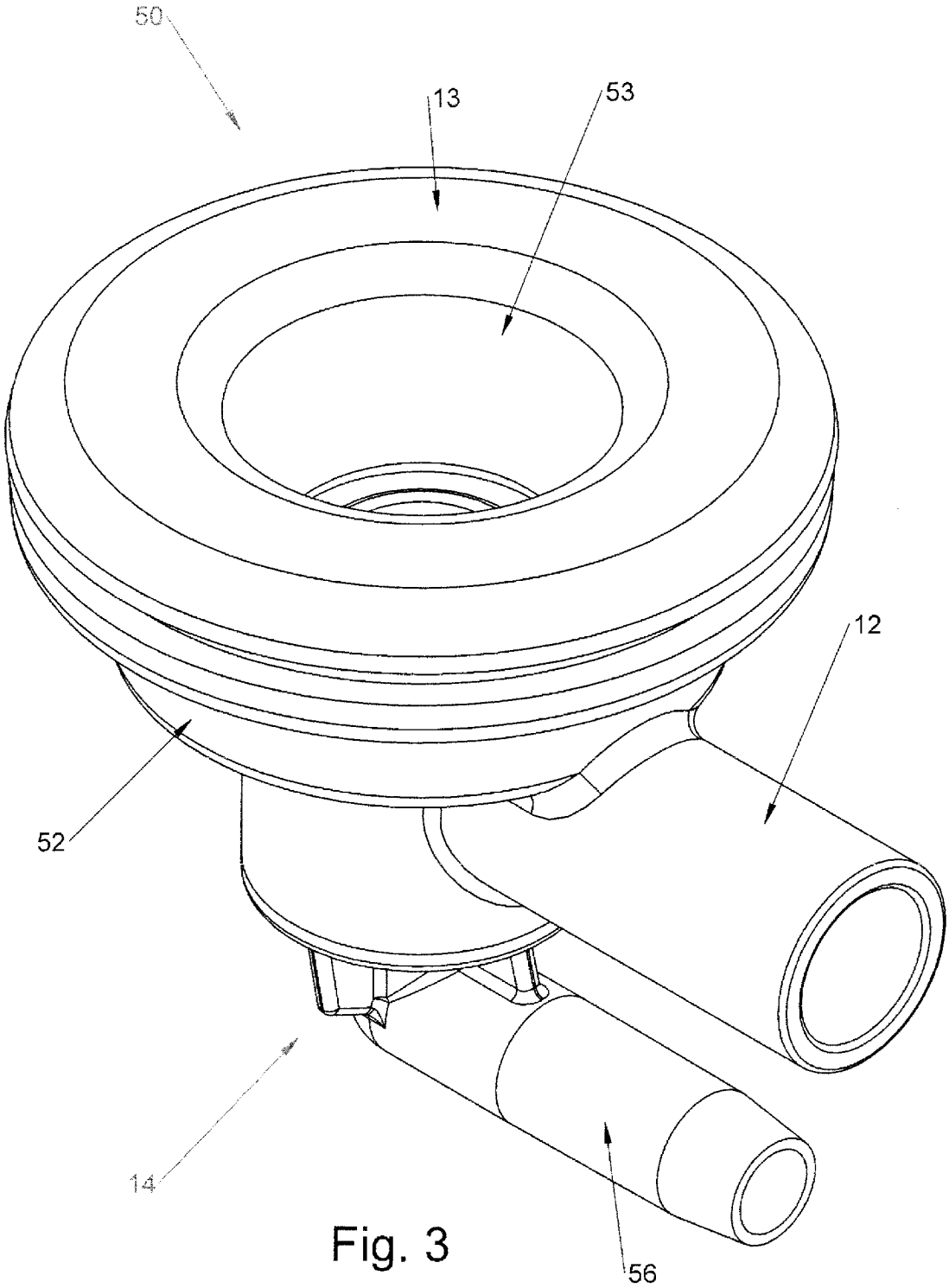
FIG. 3 is a perspective view of a fluid jet in accordance with a second preferred embodiment of the present disclosure.
Figure 4:
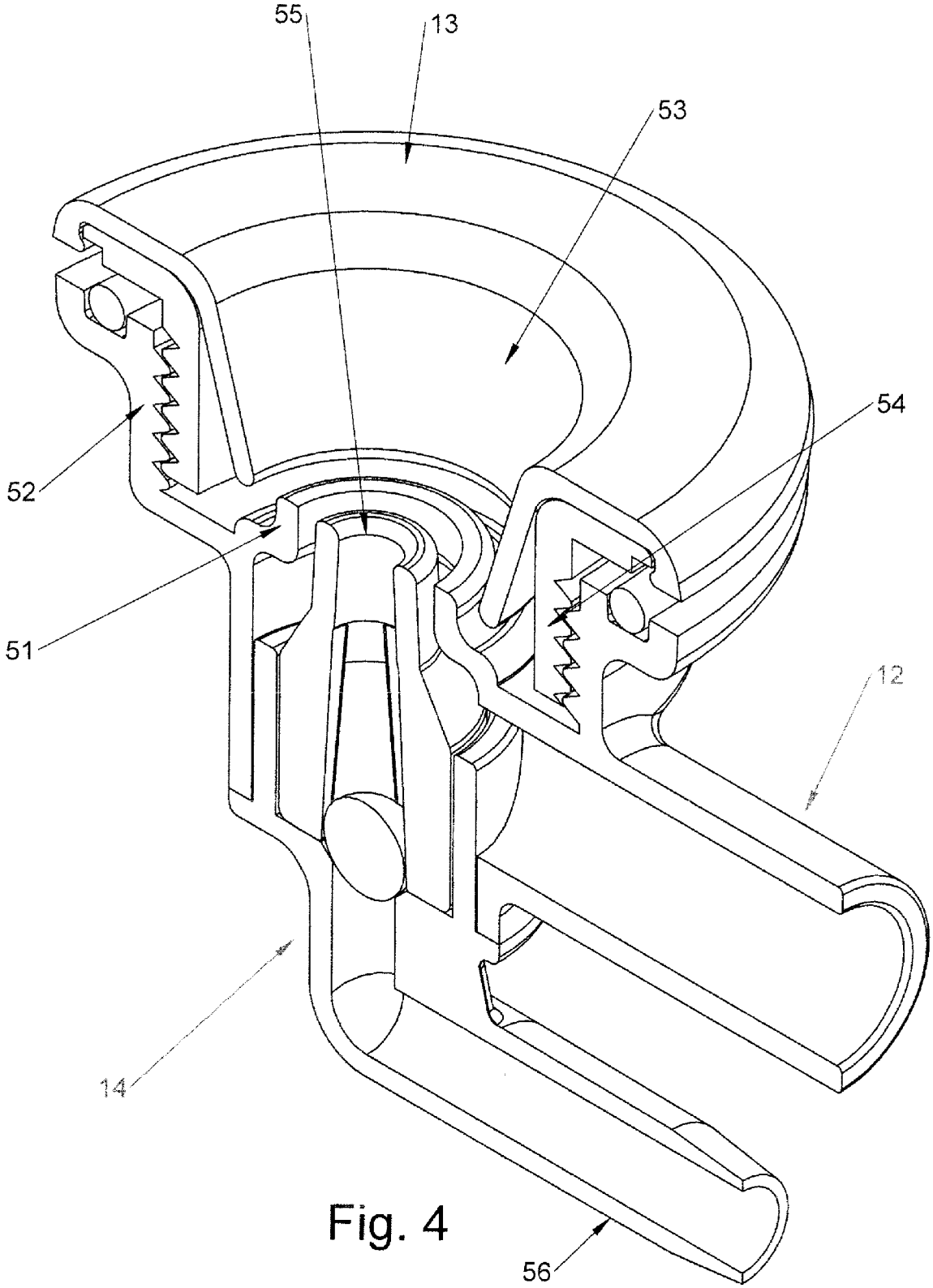
FIG. 4 is a partly sectioned perspective view of the fluid jet of FIG. 3.

Referring concurrently to FIGS. 3 and 4, a fluid jet 50 is illustrated having the water injector 12, the wall fitting 13 and the air injector 14, but in a different configuration than the fluid jet 10 of FIGS. 1 and 2. The fluid jet 50 has a throat 51 at the water outlet of the water injector 12, so as to constrict the water flux out of the water injector 12.

The flange 52 is spaced from the throat 51, so as to define a volume for a flared conduit 53 for the wall fitting 13. The wall fitting 13 has a threaded collar 54 that engages with tapping in the water injector 12, whereby the fluid jet 50 is secured to the tub by the flange 52 and the wall fitting 13.

An injector tube 55 has an outlet that is generally flush with the throat 51, to ensure the mix of the air and water flux, within the flared conduit 53. The injector tube 55 is shorter than the nozzle 42 of the fluid jet 10 (FIG. 1).

Finally, an alternative to a hose bard is illustrated in the fluid jet 50. A straight inlet 56 is provided for connection of a tubing.

Figure 5:
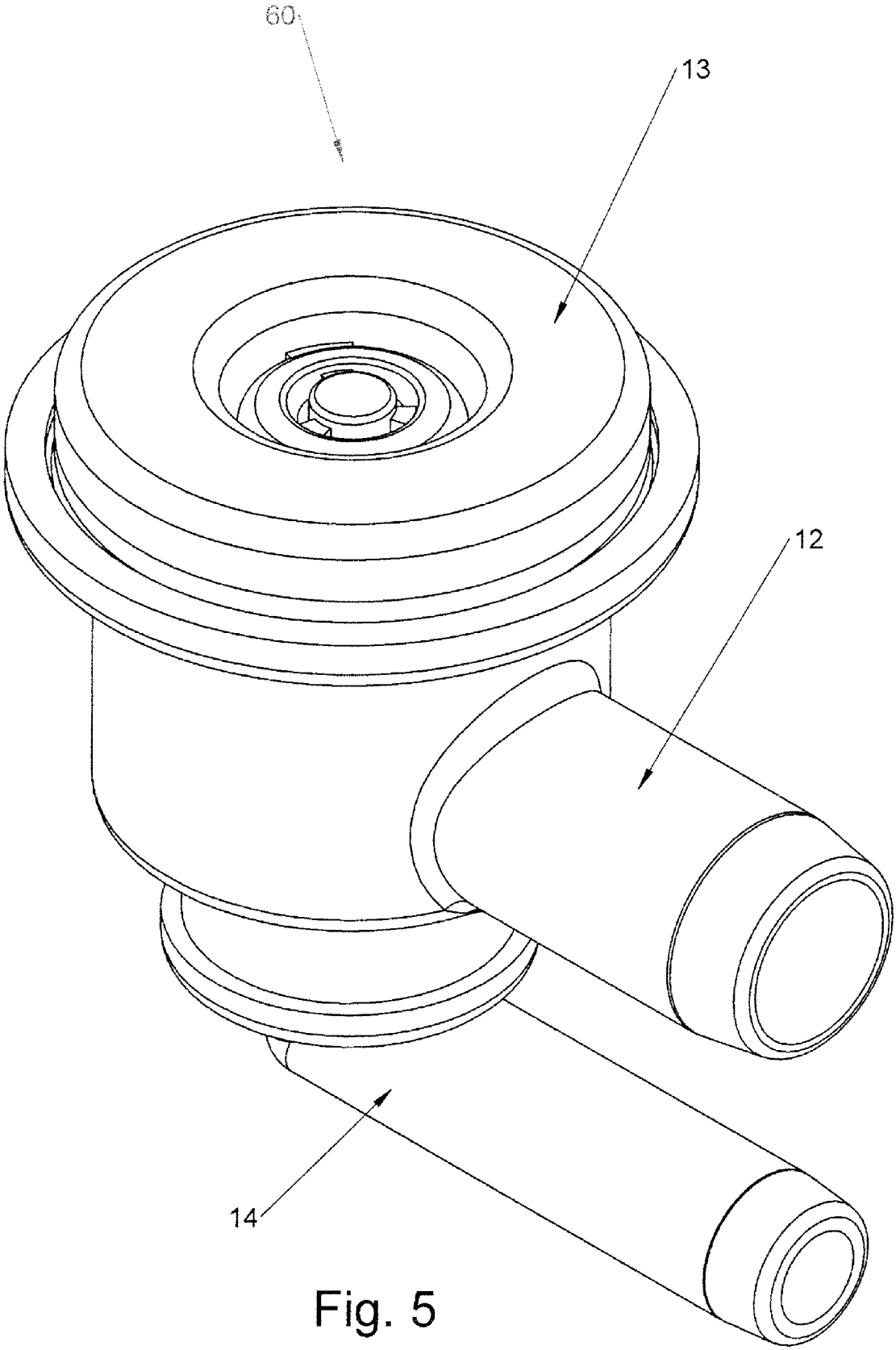
FIG. 5 is a perspective view of a fluid jet in accordance with a third preferred embodiment of the present disclosure.
Figure 6:
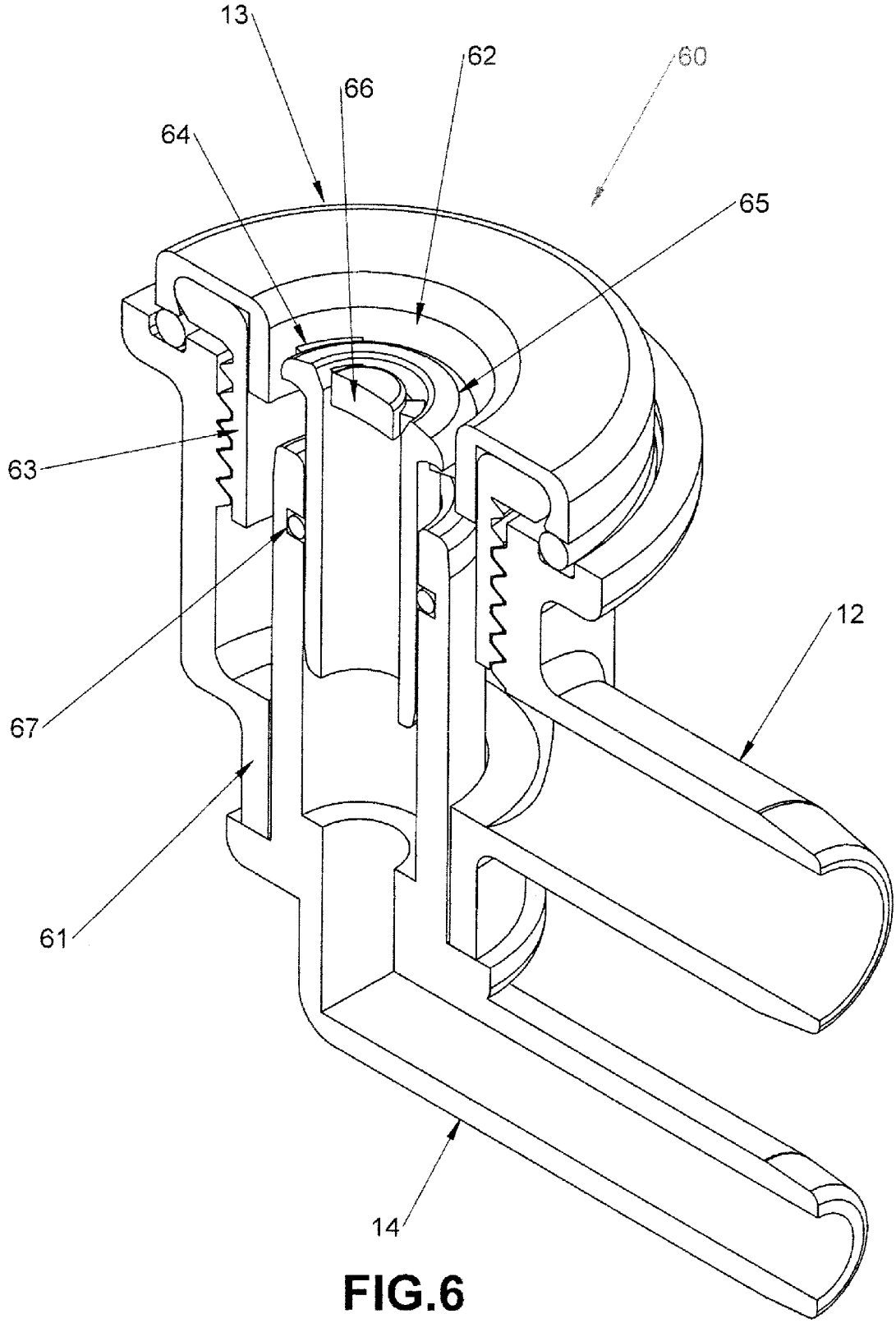
FIG. 6 is a partly sectioned perspective view of the fluid jet of FIG. 5.

Referring to FIGS. 5 and 6, a fluid jet in accordance with another preferred embodiment is shown at 60, and also has the water injector 12, the wall fitting 13 and the air injector 14. The water injector 12 of the fluid jet 60 has a neck 61 at its downstream end for supporting the air injector 14.

The water injector 12 and the wall fitting 13 are combined to define a cylindrical conduit 62 as opposed to the flared conduits of the fluid jets 10 and 50 of the previous figures. The wall fitting 13 has a threaded collar 63 for threading engagement with the water injector 12.

The wall fitting 13 has a set of arms 64 converging centrally in the conduit 62 so as to support an injector tube 65. The injector tube 65 is partially accommodated in the air injector 14. The injector tube 65 has a central disk 66. The disk 66 is provided to define a generally annular outlet for the air. Therefore, both the water and air flux exit the fluid jet 60 through annular outlets. A seal 67 is provided between the injector tube 65 and an inner surface of the air injector 14 to prevent air leaks therethrough.

Figure 7:
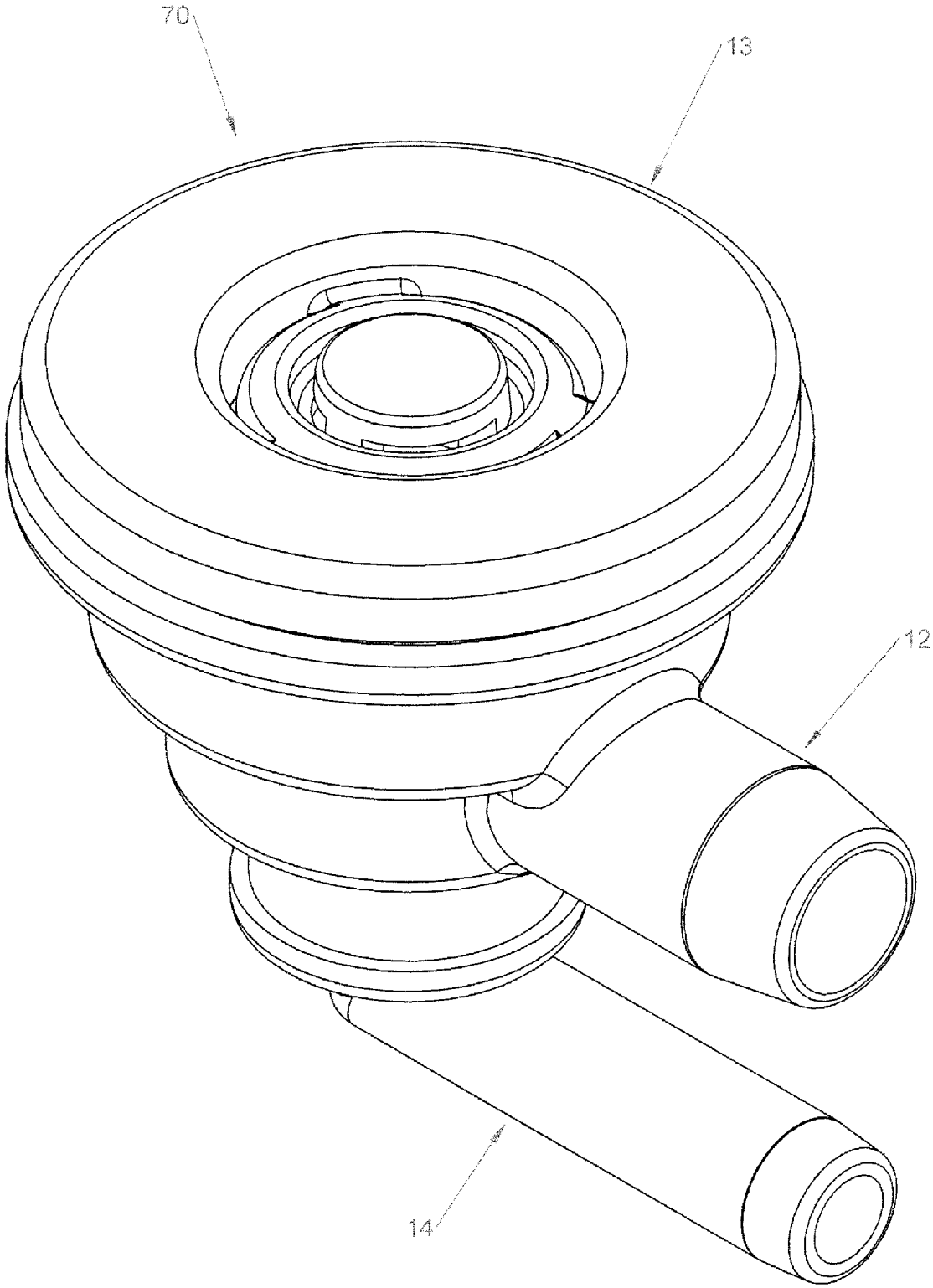
FIG. 7 is a perspective view of a fluid jet in accordance with a fourth preferred embodiment of the present disclosure.
Figure 8:
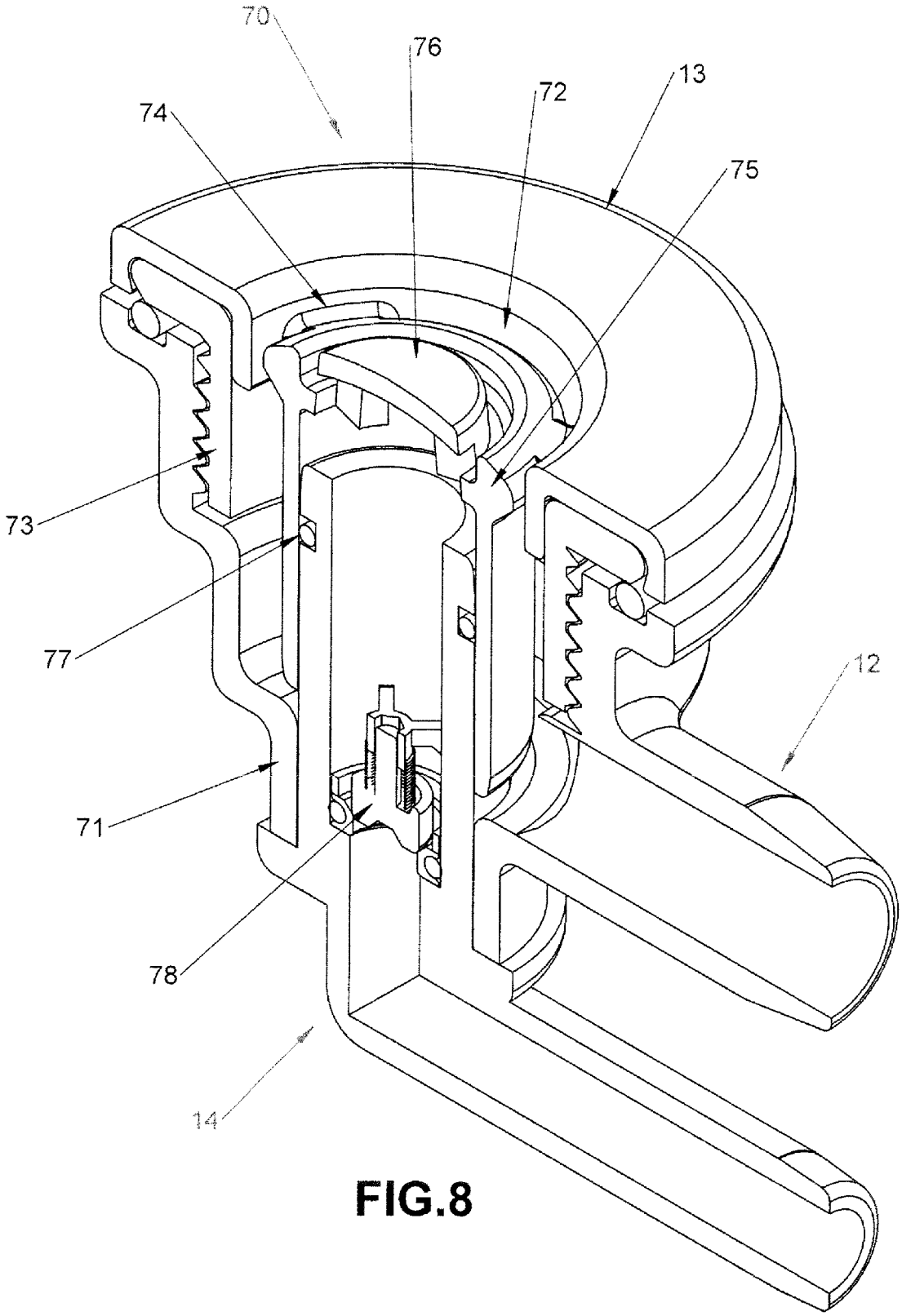
FIG. 8 is a partly sectioned perspective view of the fluid jet of FIG. 7.

Referring to FIGS. 7 and 8, a fluid jet in accordance with another preferred embodiment is shown at 70, and also has the water injector 12, the wall fitting 13 and the air injector 14. The water injector 12 of the fluid jet 70 has a neck 71 at its downstream end for supporting the air injector 14.

The water injector 12 and the wall fitting 13 are combined to define a cylindrical conduit 72 as opposed to the flared conduits of the fluid jets 10 and 50 of the previous figures. The wall fitting 13 has a threaded collar 73 for threading engagement with the water injector 12.

The wall fitting 13 has a set of arms 74 converging centrally in the conduit 72 so as to support an injector tube 75. The injector tube 65 partially covers the air injector 14. The injector tube 65 has a central disk 76. The disk 76 is provided to define a generally annular outlet for the air. Therefore, both the water and air flux exit the fluid jet 70 through annular outlets. A seal 77 is provided between the injector tube 75 and an outer surface of the air injector 14 to prevent air leaks therethrough.

A check valve 78 has a piston biased in a normally closed position by a spring, to generally prevent water infiltration in the air conduits of the massage system.

Figure 10:
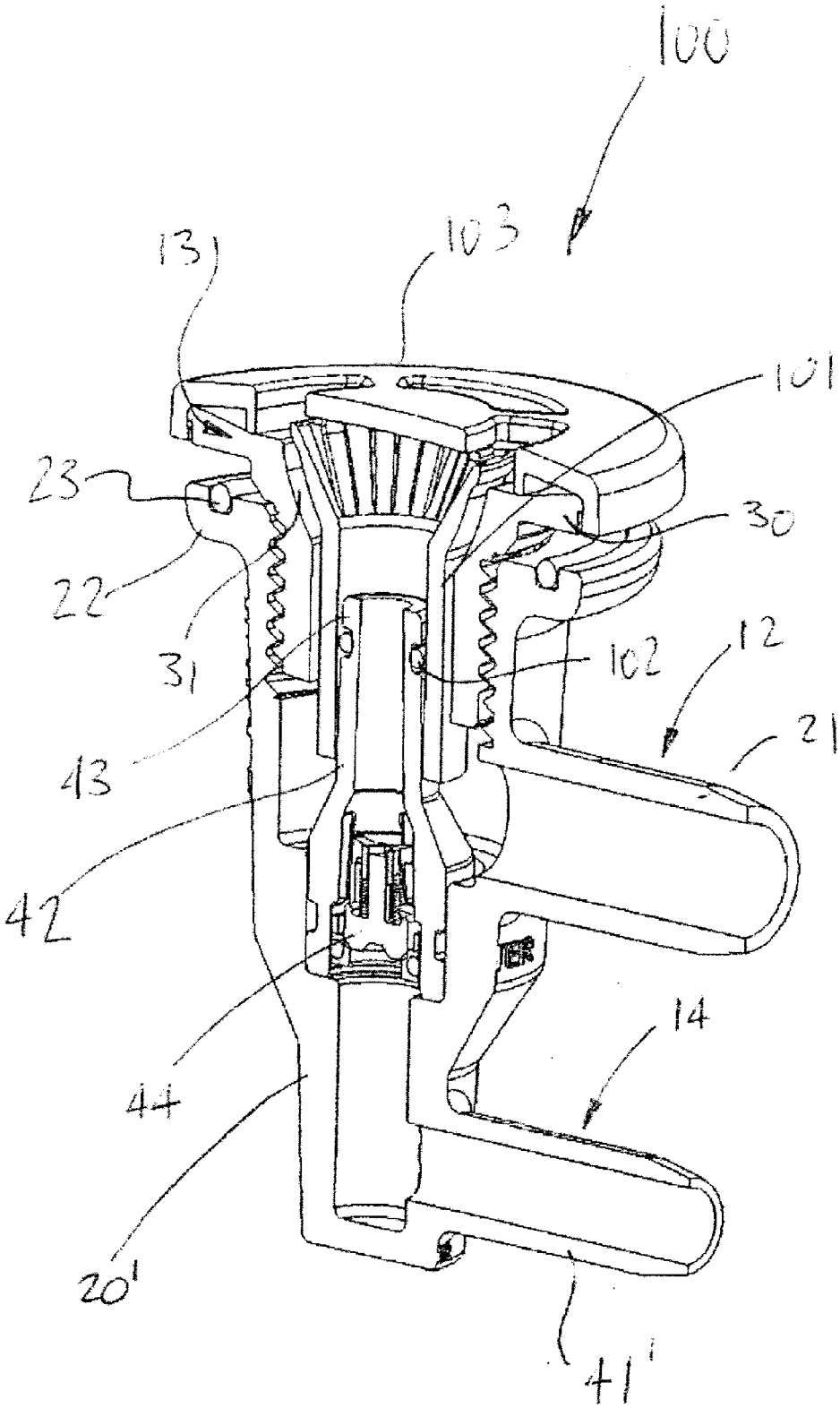
FIG. 10 is a perspective view of a fluid jet in accordance with a fifth preferred embodiment of the present disclosure.

Referring to FIG. 10, a fluid jet in accordance with another preferred embodiment is shown at 100. The fluid jet 100 has a diffuser 101 at the outlet of the nozzle 42. In the embodiment of FIG. 10, the diffuser 101 is fitted onto the end of the nozzle 42, with a seal 102 (e.g., O-ring) preventing water infiltration between the diffuser 101 and the nozzle 42. The seal 102 allows relative movement between the nozzle 42 and the diffuser 101, as the position of one with respect to another will be dependent of the thickness of the tub wall. The diffuser 101 is sized so as to be smaller in diameter than the conduit 31 of the wall fitting 13, whereby an annular gap is defined therebetween to allow water to flow from the inlet 21 and out of the wall fitting 13. The diffuser 101 may be used with any of the fluid jets 10, 50, 60 and 70, with modifications if required. It is pointed out that the check valve mechanism is removed from the fluid jet 100 to clarify the figure. Alternatively, the fluid jets described herein may be without any check valve, provided adequate water infiltration prevention devices are in the air injection network.

The fluid jet 100 also has a body 20' incorporating the air injector 14, through an inlet 41'. In the previous embodiments, the water injector 12 and air injector 14 were separate pieces, whereas they are integral in the fluid jet 100. Both configurations and other configurations are supported by the present disclosure.

A cap 103 is releasably secured to the wall fitting 13, and covers the outlet of the fluid jet 100. As will be described hereinafter, the cap 103 has openings to allow water and air mixture to be projected out of the fluid jet 100.

Figure 11:
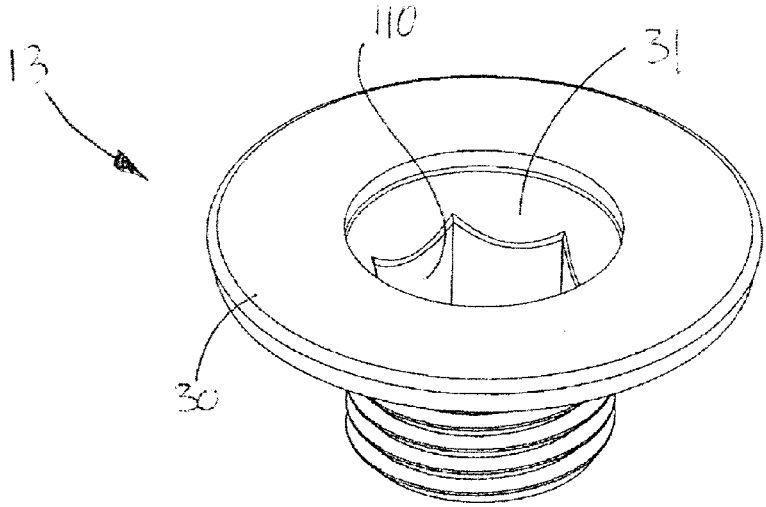
FIG. 11 is a perspective view of a wall fitting of the fluid jet of FIG. 10.

Referring to FIG. 11, an embodiment of the wall fitting 13 is illustrated, which embodiment may be used with any of the fluid jets 10, 50, 60, 70 and 100, with modifications if necessary. The wall fitting 13 has an hexagonal geometry 110 in the conduit 31. With the hexagonal geometry 110, a tool may be used to ensure that the wall fitting 13 is adequately engaged in the tubular body 20 of the water injector 12 (e.g., FIG. 1), with a wall of the tube being squeezed therebetween.

Figure 12:
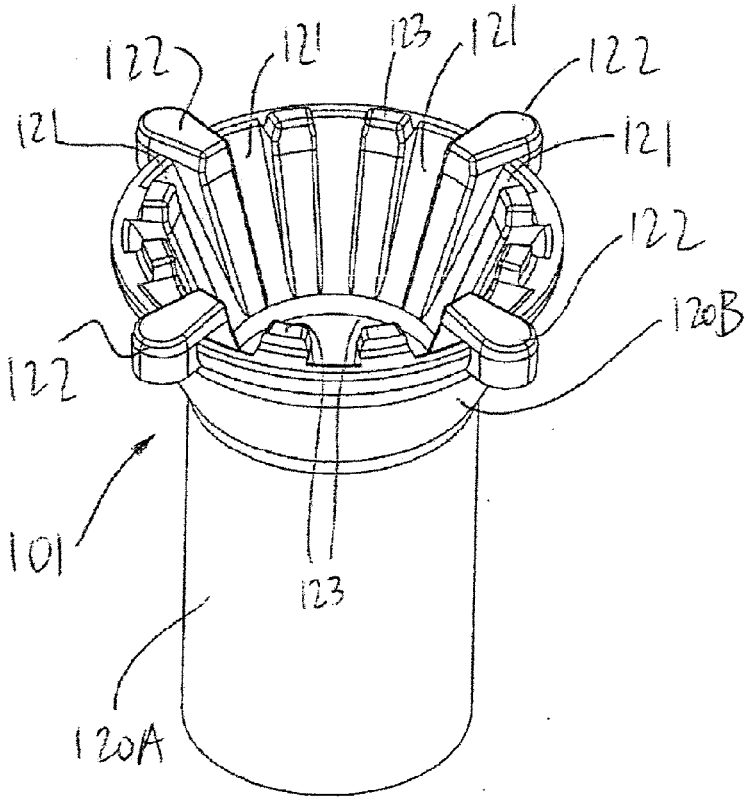
FIG. 12 is a perspective view of a diffuser of the fluid jet of FIG. 10.

Referring to FIG. 12, the diffuser 101 is illustrated separated from the fluid jet 100. The diffuser 101 has a cylindrical body 120A. The cylindrical body 120A is connected to the nozzle 42 in the manner described above. The diffuser 101 has a flared head 120B downstream of the cylindrical body 120A. In an inner surface of the flared head 120B, channels 121 are defined. Posts 122 are spaced out in the inner surface of the flared head 120B, and are used for the connection of the cap 103 to the fluid jet 100 (FIG. 10), as is described hereinafter.

At the end of the flared head 120B, the channels 121 are separated by ribs 123. The end of the ribs 123 come into contact against the cap 103 as shown in FIG. 10 to define outlets at the end of the channels 121. Accordingly, there are a plurality of outlets on the periphery of the flared head 120B, as defined by the sequence of channels 121, ribs 123 and cover 103. The outlets enhance the production of micro bubbles as pressurized air exits therethrough into the liquid of the tub, as combined with pressurized liquid exiting the wall fitting 13.

Figure 13:
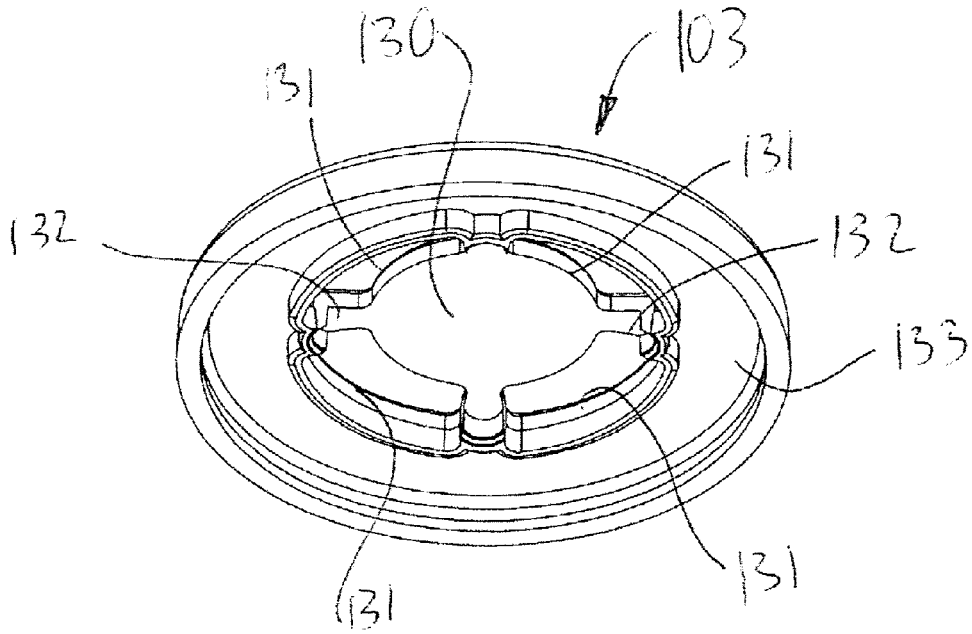
FIG. 13 is an underside perspective view of a circular cap of the fluid jet of FIG. 10.

Referring to FIG. 13, an undersurface of the cap 103 is shown in greater detail. The cap 103 has a central disc 130 that will be in register with the flared head 120B of the diffuser 101 to define the openings. Openings 131 are provided on the periphery of the central disc 130, and are in register with the outlets of the flared head 120B to allow the pressurized air and water mixture to exit. Arms 132 join the central disc 130 to an annular body 133. The arms 132 have a shape complementary to that of the posts 122 for mating engagement therebetween. Accordingly, the diffuser 101 is held captive by the posts 122 being retained between the wall fitting 13 and the arms 132. Moreover, the annular body 133 may be screwed or clipped to a periphery of the flange 30 of the wall fitting 13.

Figure 14:
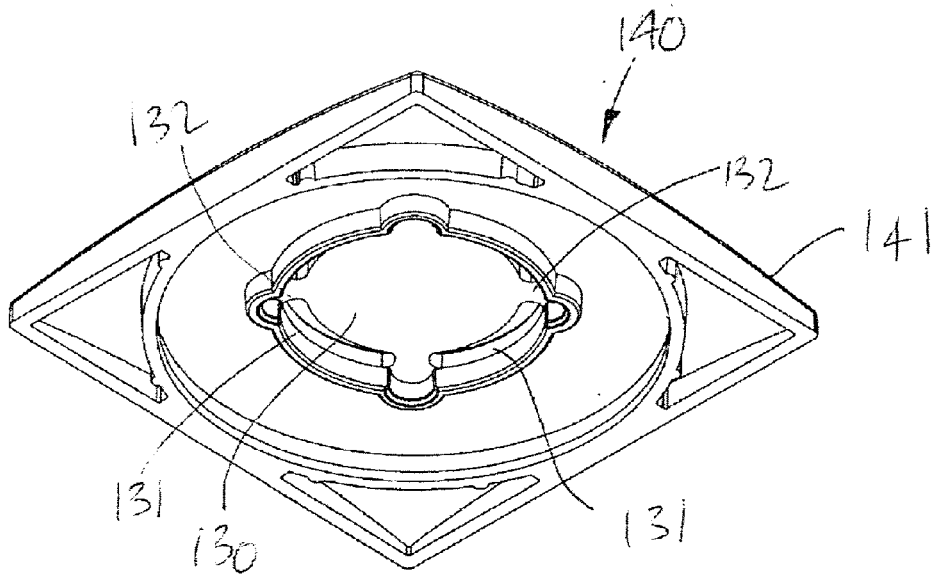
FIG. 14 is an underside perspective view of a square cap of the fluid jet of FIG. 10.

Referring to FIG. 14, there is illustrated a cap 140 having a square shape, as opposed to a circular one for the cap 103. As the caps 103 and 140 will be the visible component of the jets 10, 50, 60, 70 and 100 in the tub, the caps have ornamental features. Other shapes are considered as well.

Figure 15:
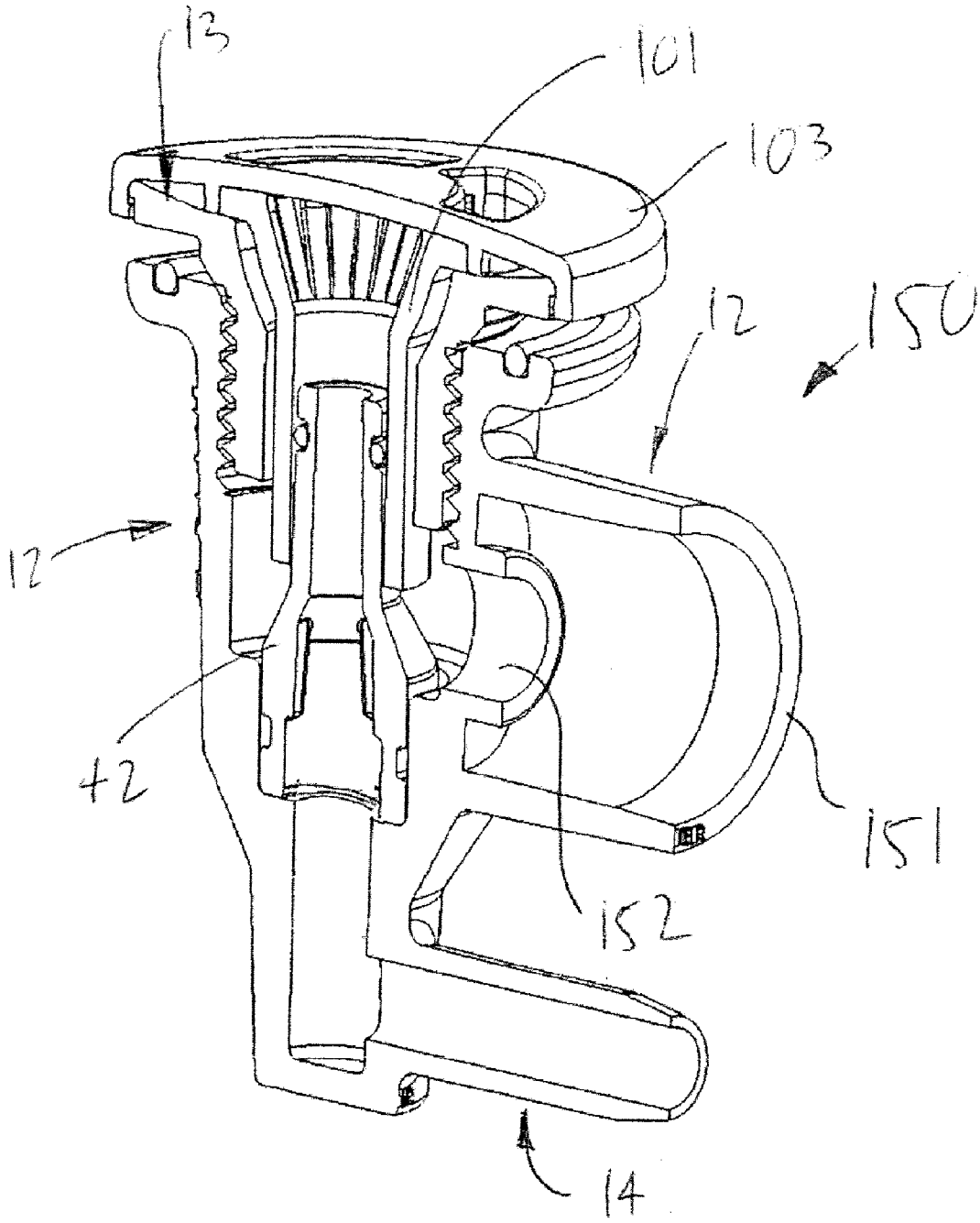
FIG. 15 is a perspective view of a fluid jet in accordance with a sixth preferred embodiment of the present disclosure.

Referring to FIG. 15, another embodiment of a fluid jet is illustrated at 150. The fluid jet 150 is similar to the fluid jet 100, whereby like components will bear like reference numerals. The fluid jet 150 has a lateral inlet 151 defining a female connector for accommodating a hose, as opposed to a male connector defined by the lateral inlet 21 (FIG. 1). A shoulder 152 prevents any adhesive (e.g., between hose and inlet 151) to enter the body of the fluid jet 150.

The fluid jets 50, 60 and 70 may be used in the manner described for the fluid jet 10. Moreover, different configurations are considered for the mixture of the flux out of the jets. For instance, different outlets may be provided for a same jet, with the water and air flux directed toward one another to produce the micro-bubbles.

Figure 16:
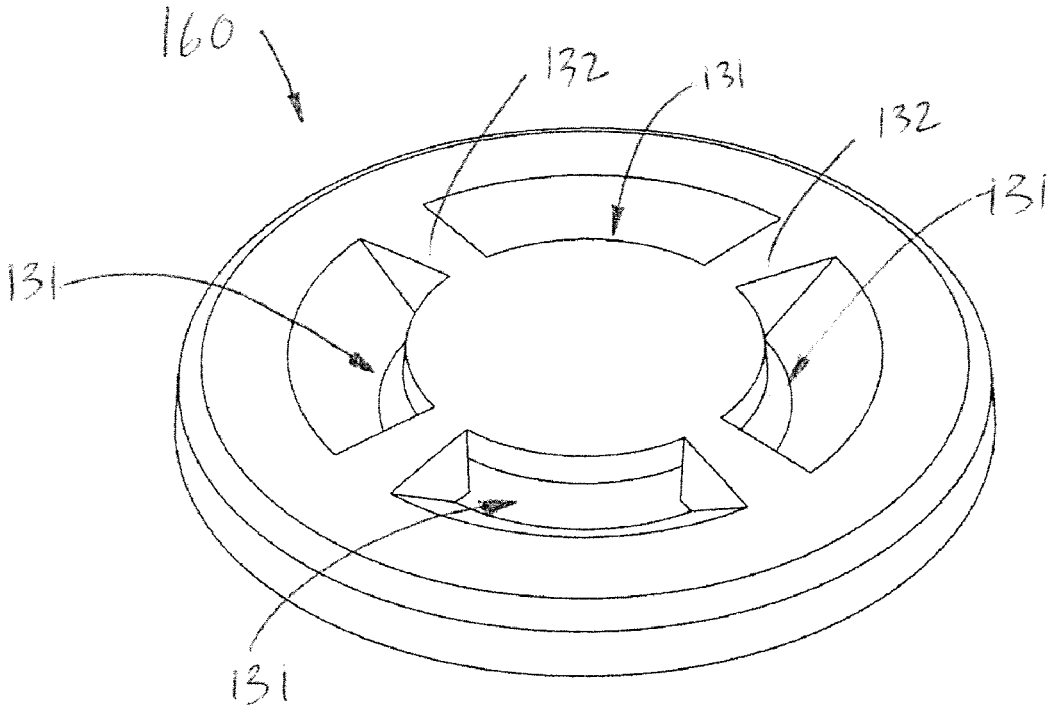
FIG. 16 is a top perspective view of another embodiment of the circular cap of the fluid jet of FIG. 10.
Figure 17:
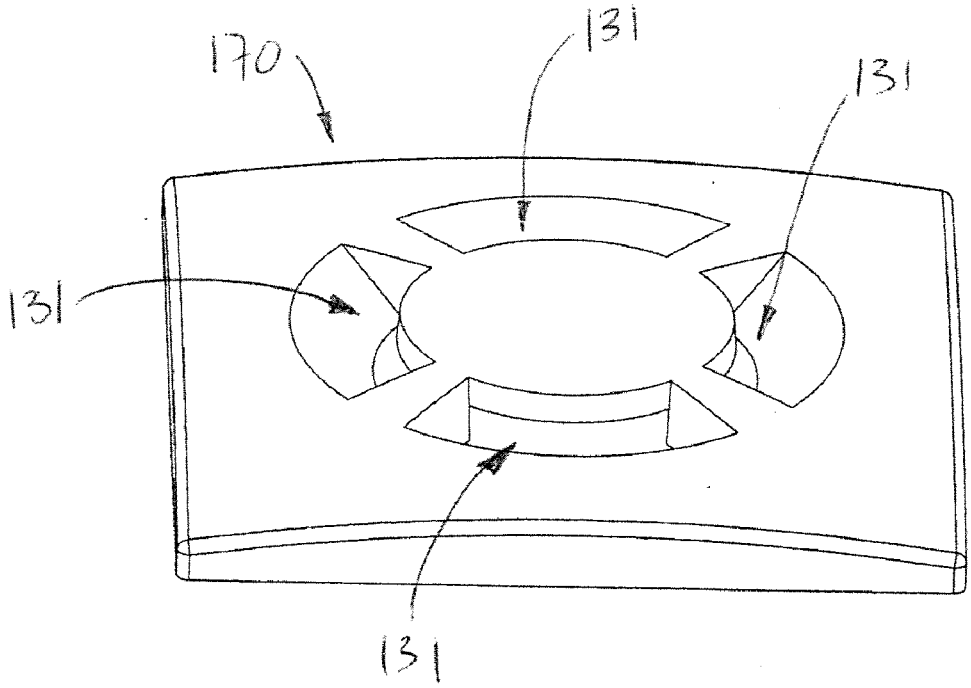
FIG. 17 is a top perspective view of a square cap of another embodiment of the fluid jet of FIG. 10.

Referring to FIG. 16, an alternative embodiment of the cap 140 is illustrated as cap 160, with like reference numerals representing like components. The openings 161 have a different geometry in the cap 160, in that there is a throat portion that subsequently flares. This geometry has the effect of decreasing the velocity of the fluid stream exiting the fluid jet 10, while increasing the section of the fluid stream. Accordingly, the embodiment of FIG. 16 is well suited for shallow tubs. Referring to FIG. 17, an alternative embodiment of the cap 103 is illustrated as cap 170, with like reference numerals representing like components. The openings 171 are similar to the openings 161 of the cap 160 to obtain a similar effect.

It is pointed out that the fluid jet 10 may be installed without the fitting 13. For instance, the water injector 12 may be connected directly to the tub wall. For instance, the water injector 12 may be connected to the tub wall in a similar fashion as the fluid jet described in U.S. Patent Application Publication No. 2002/0062520, by Castellote.

The invention claimed is:

1. A fluid jet for injecting fluids in the liquid of a tub through a throughbore in a wall of the tub, comprising:

a gas injector comprising a hollow body having a gas inlet adapted to receive a gas flow from a pressurized gas source, and a gas outlet for producing a flux of gas with the gas flow; and a liquid injector comprising a hollow body having a liquid inlet adapted to be connected to a pressurized liquid source to receive a liquid flow therefrom, and a liquid outlet for producing a flux of liquid with the liquid flow, the gas injector being received in the hollow body of the liquid injector, for the gas outlet and the liquid outlet to form a common jet outlet in which the liquid outlet has an annular shape with the gas outlet being in a center of the annular shape, the liquid injector adapted to be secured to the wall of the tub opposite the throughbore such that fluids exiting the common jet outlet are directed concurrently through the throughbore into the liquid of the tub.

2. The fluid jet according to claim 1, further comprising a fitting connected to the liquid injector and adapted to be secured to the wall of the tub opposite the throughbore.

3. The fluid jet according to claim 1, wherein both the gas injector and the liquid injector have a circular inner section portion, with the gas outlet being concentrically positioned with respect to the liquid outlet, whereby the liquid outlet defines the annular shape about the gas outlet.

4. The fluid jet according to claim 3, further comprising a flared diffuser at the gas outlet to diffuse the flux of gas.

5. The fluid jet according to claim 4, further comprising a cap connected to the common jet outlet, the cap having openings through which fluids exiting the common jet outlet pass, the openings having predetermined shapes to control the flux of fluids exiting the jet.

6. The fluid jet according to claim 5, wherein the flared diffuser has a plurality of inner channels along a direction of the flux, the cap contacting the flared diffuser such that a plurality of outlets are defined by the inner channels and a periphery of the openings in the cap to split the flux of gas exiting the gas injector.

7. The fluid jet according to claim 3, further comprising a cap connected to the common jet outlet, the cap having openings through which fluids exiting the common jet outlet pass, the openings having predetermined shapes to control the flux of fluids exiting the jet.

8. The fluid jet according to claim 2, wherein the liquid injector comprises a flange at the liquid outlet, the flange adapted to be against a hidden surface of the wall of the tub when the fluid jet is secured to the wall of the tub.

9. The fluid jet according to claim 8, wherein the fitting has a conduit body and a flange, the flange adapted to be against an exposed surface of the wall of the tub when the fluid jet is secured to the wall of the tub, the conduit body adapted to pass through the throughbore in the wall of the tub and being releasably received in the liquid injector such that the fluid jet is secured by the flanges of the fitting and of the liquid injector being on opposite sides of the wall.

10. The fluid jet according to claim 9, wherein the conduit body of the fitting is threaded and an inner surface of the liquid injector is tapped, whereby the conduit body is screwingly engaged to the liquid injector.

11. The fluid jet according to claim 10, wherein an inner surface of the conduit body has a hexagonal shape adapted to accommodate a tool head during installation.

12. The fluid jet according to claim 2, further comprising a cap connected to the common jet outlet, the cap having openings through which fluids exiting the common jet outlet pass, the openings having predetermined shapes to control the flux of fluids exiting the jet.

13. The fluid jet according to claim 1, further comprising a unidirectional flow mechanism in the gas injector.

14. The fluid jet according to claim 1, wherein the hollow body of the liquid injector has a tubular shape with a closed end and an open end, with the open end defining the liquid outlet, the hollow body further comprising a pair of conduits projecting laterally therefrom, a first of the conduits being in fluid communication with the gas inlet of the gas injector so as to interface the gas injector with the pressurized gas source, a second of the conduits defining the liquid inlet.

15. An assembly of a plurality of the fluid jet according claim 1 with a tub.

16. A method for injecting fluids in the liquid of a tub, comprising:

providing a fluid jet having a liquid injector and a gas injector inside the liquid injector such that an outlet of the liquid injector defines an annular shape about an outlet of the gas injector, with the gas injector and the liquid injector being arranged such that gas and liquid flux exiting the injectors converge through a throughbore in a wall of the tub;

supplying pressurized gas to the gas injector of the fluid jet; and simultaneously supplying pressurized liquid to the liquid injector of the jet;

whereby gas and liquid exit the jet concurrently into the liquid of the tub.

17. The method according to claim 16, wherein providing the fluid jet comprises providing the gas injector with a plurality of outlets to split the gas flux.

18. The method according to claim 16, further comprising providing on an outlet of the fluid jet a cap with openings each having a throat and a flared section to spread the gas and liquid flux converging out of the fluid jet into the liquid of the tub.

* * * * *